United States Patent [19]

Klauer

[11] 4,015,151

[45] Mar. 29, 1977

[54] PIEZOELECTRIC IGNITER WITH A STRIKING MECHANISM

[75] Inventor: Hans-Dieter Klauer, Wehrheim, Germany

[73] Assignee: Braun Aktiengesellschaft, Frankfurt am Main, Germany

[22] Filed: Oct. 30, 1975

[21] Appl. No.: 627,068

Related U.S. Application Data

[62] Division of Ser. No. 469,762, May 14, 1974, abandoned.

[52] U.S. Cl. ..... 310/8.7

[51] Int. Cl.[2] ..... H01L 41/04

[58] Field of Search ..... 310/8.3, 8.5, 8.7, 9.1, 310/9.4; 317/DIG. 11

[56] References Cited

UNITED STATES PATENTS

| | | | |
|---|---|---|---|
| 3,586,888 | 6/1971 | Dorfman | 310/8.3 |
| 3,693,033 | 9/1972 | Troesh | 310/15 X |
| 3,855,488 | 12/1974 | Britton et al. | 310/8.7 X |
| 3,898,534 | 8/1975 | Mohr | 310/8.7 X |
| 3,936,678 | 2/1976 | Mohr | 310/8.7 |

*Primary Examiner*—Mark O. Budd
*Attorney, Agent, or Firm*—Frederick E. Bartholy

[57] ABSTRACT

A piezoelectric igniter with a manually operable striking mechanism which comprises a hammer, a piezoelectric transducer, and an energy storing or compression spring acting on said hammer. The hammer is held in its rest position by a release device adapted to release the hammer when a definite compressive force is developed in the compression spring. A bounce plate is mounted at the end of the transducer facing the hammer and a return spring is provided between said bounce plate and said hammer. The transducer has a lateral clearance to a housing which receives all component parts.

5 Claims, 2 Drawing Figures

PIEZOELECTRIC IGNITER WITH A STRIKING MECHANISM

CROSS-REFERENCE

This is a division of co-pending application Ser. No. 469,762 filed May 14, 1974, now abandoned.

BACKGROUND OF THE INVENTION

The invention relates to a piezoelectric igniter with a striking mechanism, more especially for lighters, having a piezoelectric transformer or transducer, a hammer which is movable in the direction of the axis of this latter and which co-operates with a compression spring which can be compressed by an actuating member. Also, a movement release device for the hammer is provided as well as a housing which receives all these parts and at the one front end of which the piezoelectric transducer is situated.

Hitherto, the piezoelectric transducer of such igniters was firmly inserted in the housing. This results in the disadvantage that a portion of the striking energy is lost through the friction of the piezoelectric transducer on the internal wall of the housing and therefore is not available for the generation of electric energy.

In another known type of construction of a piezoelectric igniter, the side of the piezoelectric transducer that is facing the hammer butts against a stop of the housing, and the other front surface of the transducer is biased by an additional spring. Such an igniter necessitates additional parts and accordingly is expensive in production.

SUMMARY OF THE INVENTION

It is an object of the invention to provide a piezoelectric igniter with a striking mechanism of the type mentioned at the beginning which is constructed in a simple manner and has a comparatively high degree of efficiency and leads to a relatively long duration of the sparks produced by the electric energy of the piezoelectric transducer.

The gist of the invention resides in the features that a bounce plate is mounted at the side face of the piezoelectric transducer which faces the hammer and that the hammer as well as the bounce plate form magnetically conductive parts. At least one of these parts is provided with a permanent magnet or serves as a flux conductive part for magnetic field lines emanating from a nearby permanent magnet.

The bounce plate may comprise a magnetically conductive plate, which is provided with a projecting bounce mandrel as well as with a permanent magnet surrounding the bounce mandrel. Preferably, the permanent magnet is annularly shaped and axially magnetized. Also, the permanent magnet is preferably freely movably mounted with respect to the magnetic bounce plate.

Piezoelectric igniters having a trigger or movement release device comprising a magnetic retaining circuit accomodated in or arranged in the vicinity of the hammer, a preferred embodiment of the invention consists in that the hammer is provided at its impact region with a device generating a stray flux, for instance a slot or armature.

BRIEF DESCRIPTION OF THE DRAWINGS

Hereinafter the invention will be further described with respect to several preferred embodiments, reference being made to diagrammatic drawings.

DETAILED DESCRIPTION OF THE EMBODIMENTS

Figure 1:
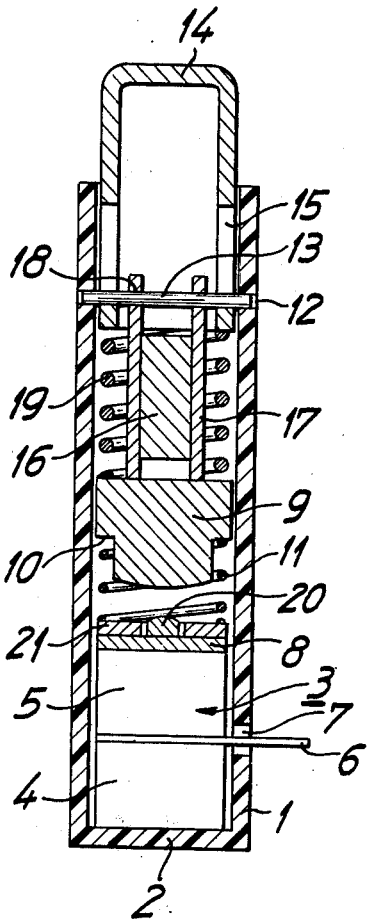
FIG. 1 is a longitudinal section through a piezoelectric igniter according to the invention.

The piezoelectric igniter shown in FIG. 1 comprises a cylindrical housing 1 made of a plastics material. The housing has a circular cross-section and is closed at one end by a bottom 2. The interior of the housing is likewise shaped. On the bottom 2 of the housing rests a piezoelectric transformer 3 which consists of two piezoelectric barium titanate crystals 4 and 5 in series arrangement between which there is inserted an electrode 6, which extends towards the outside through an aperture 7 in the housing. A bounce plate 8 made of a ferromagnetic material is situated on top of the piezoelectric barium titanate body 5. Said bounce plate may be bonded to the barium titanate body in any known manner and has a central bounce mandrel 20, which protrudes towards a hammer 9 and forms an integral part with the bounce plate 8. An axially magnetized annular magnet 21 is disposed around said bounce mandrel.

The hammer 9 is provided, at the shell region pointing towards the bounce plate 8, with a circumferential recess which ends at a shoulder 10. Disposed between the annular magnet 21 and the shoulder 10 there is a return spring 11 which is parallely ground at its ends.

Near the open end of the housing 1 there are diametrically opposite bores 12, through which a holding pin 13 is driven, which serves for holding an actuating cap 14 and a permanent magnet arrangement.

The actuating cap 14 is cup-shaped and comprises two diametrically opposite longitudinal holes 15 which extend in an axially parallel relationship and through which the holding pin 13 is inserted.

The permanent magnet arrangement comprises a parallelepiped-shaped permanent magnet 16, at the two opposite longitudinal side faces of which hole plates 17 are fitted which project, on both sides, somewhat beyond the length of the permanent magnet 16. The pole plates 17 are glued to the permanent magnet 16.

The upper ends of the pole plates 17 that project at the top are provided with bores 18 through which the holding pin 13 is placed, which secures the permanent magnet arrangement, consisting of the parts 16 and 17, fixedly in the housing.

The lower ends of the pole plates 17 butt against a front surface of the hammer 9, which consists of a ferromagnetic material and is therefore retained by the magnetic flux.

The piezoelectric igniter furthermore comprises a compression spring 19, which acts on the front surface of the hammer 9, on the one hand, and on the front edge of the open end of the actuating cap 14, on the other hand.

The piezoelectric igniter has the following mode of operation. In the rest position, shown in FIG. 2, the compression spring 19 is practically in its relaxed state and does not exert any substantial force on the hammer 9. If the actuating cap 14 is now pressed downwards, the compression spring 19 is compressed and, accordingly, an increasing force is exerted on the hammer 9. As soon as the compressive force of the spring 19 exceeds the retaining force of the permanent magnet arrangement, the hammer detaches itself from the same and is impelled downwards against the bounce mandrel 20, while the return spring 11 already exerts a pressure on the piezoelectric transducer before the hammer 9 impinges on the bounce mandrel.

The return spring 11 may be dimensioned such that in the state of rest a small compressive force is exerted on the piezelectric transducer 3. However, it is also possible to use a return spring which does not generate a compressive force unless the hammer 9 moves in the direction of the bounce plate 8.

The annular magnet 21 loosely fits around the bounce plate 8 and is pressed against it by the return spring 11. Thus, the annular magnet 21 is held in its position. Alternatively, the annular magnet may be glued to the bounce plate 8.

Of course, the retaining force of the annular magnet 21 must be smaller than the compressive force of the return spring 11 in its compressed state in order to achieve that the hammer 9 may return into its position of rest.

Figure 2:
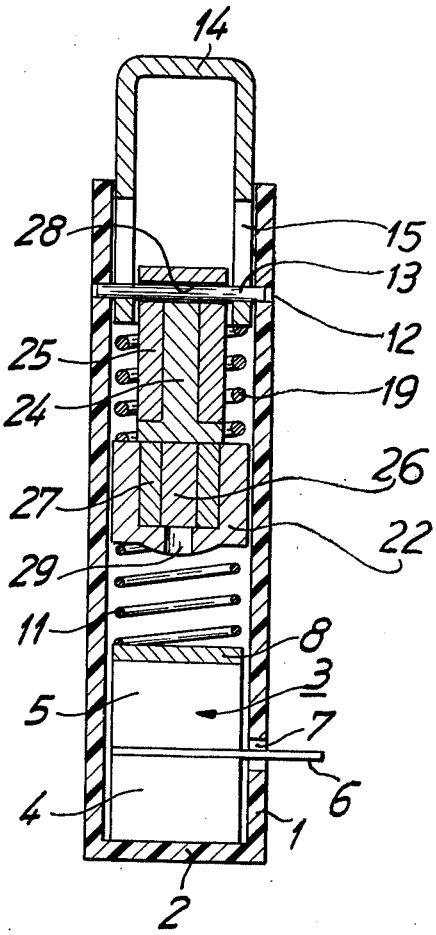
FIG. 2 is a longitudinal section through another embodiment of a piezoelectric igniter according to the invention.

FIG. 2 shows another embodiment in which, with respect to FIG. 1, the same structural parts are provided with the same reference numerals.

The piezoelectric igniter according to FIG. 2 substantially differs from the construction according to FIG. 1 with respect to the construction of the permanent magnet arrangement and the hammer.

The hammer consists of a cup-shaped housing 22 made of a ferromagnetic material, which housing has a curved surface at its bottom region and comprises a slot 29 or any other suitably formed aperture. Disposed in the interior of the hammer there is a permanent magnet 26 which is axially magnetized and one pole end of which is placed onto the bottom of the cup-shaped housing part 22. The gap between the permanent magnet 26 and this housing part is filled with lead 27.

Disposed above the hammer there is a yoke part, which consists of an iron core 24 and a non-magnetic jacket 25. The latter is provided with a transveral bore 28, through which the holding pin 13 is placed. At the side facing the hammer the iron core 24 comprises an area having a widened cross-section which extends beyond the front surface of the cup-shaped housing part 22.

The mode of operation of this embodiment corresponds to that according to FIG. 1. However, the magnetic force of attraction between the hammer and the bounce plate is not generated by a special magnet but is generated by the permanent magnet 26. As soon as the hammer has detached itself from the yoke part 24, 25 and impinges on the bounce plate 8, a portion of the field lines emanating from the permanent magnet 26 is transferred, through the gap 29, to the ferromagnetic bounce plate 8, so that a force of attraction is generated between the latter and the hammer. By this means the duration of the spark is increased in a similar manner as in the case of the piezoelectric igniter according to FIG. 1.

I claim:

1. A piezoelectric igniter with a striking mechanism, more especially for lighters, having a piezoelectric transducer, a hammer which is movable in the direction of the latter and which co-operates with a compression spring, a movement release device for said hammer, and a housing which receives these parts and adjacent the closed front end of which the piezoelectric transducer is arranged, wherein a bounce plate is mounted at the side face of the piezoelectric transducer facing said hammer, wherein said hammer and said bounce plate form magnetically conductive parts, and wherein at least one of these parts is provided with a permanent magnet.

2. A piezoelectric igniter as claimed in claim 1, wherein said magnetic bounce plate comprises a magnetically conductive plate which is provided with a projecting bounce mandrel, and further comprises a permanent magnet surrounding said bounce mandrel.

3. A piezoelectric igniter as claimed in claim 2, wherein said permanent magnet is annularly shaped and axially magnetized.

4. A piezoelectric igniter as claimed in claim 2, wherein the permanent magnet is movably mounted with respect to said bounce plate.

5. A piezoelectric igniter as claimed in claim 1, wherein the movement release device is a magnet retaining circuit having a permanent magnet accomodated within said hammer, wherein said hammer is provided in its impact region with a device for generating a stray flux.

* * * * *